US007883081B2

(12) United States Patent
Iguchi et al.

(10) Patent No.: US 7,883,081 B2
(45) Date of Patent: Feb. 8, 2011

(54) SHEET FINISHING APPARATUS AND CONTROL METHOD

(75) Inventors: Ken Iguchi, Shizuoka (JP); Hiroyuki Taguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 27 days.

(21) Appl. No.: 12/497,124

(22) Filed: Jul. 2, 2009

(65) Prior Publication Data

US 2010/0007074 A1 Jan. 14, 2010

Related U.S. Application Data

(60) Provisional application No. 61/079,083, filed on Jul. 8, 2008, provisional application No. 61/079,086, filed on Jul. 8, 2008.

(51) Int. Cl.
*B65H 37/04* (2006.01)

(52) U.S. Cl. ..... 270/58.17; 270/58.07; 270/58.09

(58) Field of Classification Search ..... 270/58.08, 270/58.09, 58.07, 58.14, 58.17, 58.16, 58.18
See application file for complete search history.

(56) References Cited

U.S. PATENT DOCUMENTS 5,478,062 A * 12/1995 Horiuchi et al. ..... 270/58.08
5,931,460 A * 8/1999 Kadowaki et al. ..... 271/220
6,220,592 B1 * 4/2001 Watanabe et al. ..... 271/241
7,392,983 B2 * 7/2008 Kodama et al. ..... 271/249
7,419,150 B2 * 9/2008 Kushida et al. ..... 270/58.07
7,461,837 B2 * 12/2008 Saito et al. ..... 270/58.07

FOREIGN PATENT DOCUMENTS

| | | |
|---|---|---|
| JP | 2000-211805 | 8/2000 |
| JP | 2006-273543 | 10/2006 |
| JP | 2007-1757 | 1/2007 |
| JP | 2007-193193 | 8/2007 |

* cited by examiner

*Primary Examiner*—Patrick Mackey
(74) *Attorney, Agent, or Firm*—Patterson & Sheridan, LLP

(57) ABSTRACT

A sheet finishing apparatus includes: a puncher which moves between a penetrate position and a standby position; a detection unit which detects a lateral edge of a sheet; a standby tray which supports the sheet passed through the puncher, by a pair of tray members; a lateral alignment unit which holds and aligns the sheet falling off the standby tray, by a pair of alignment boards; a moving mechanism which moves the position of the standby tray or the alignment boards in a direction orthogonal to the carrying direction of the sheet; and a control unit which measures a quantity of misalignment of the sheet by using a result of detection of the lateral edge from the detection unit and controls the moving mechanism in accordance with the quantity of misalignment.

20 Claims, 15 Drawing Sheets

SHEET FINISHING APPARATUS AND CONTROL METHOD

CROSS-REFERENCE TO RELATED APPLICATION

This application is based upon and claims the priority of U.S. Provisional Application No. 61/079,083, filed on Jul. 8, 2008, and U.S. Provisional Application No. 61/079,086, filed on Jul. 8, 2008, the entire contents of which are incorporated herein by reference.

TECHNICAL FIELD

The present invention relates to a sheet finishing apparatus which carries out finishing of sheets discharged from an image forming apparatus such as a copy machine, printer or multi-function peripheral (MFP), and a control method.

BACKGROUND

Recently, a sheet finishing apparatus is provided after an image forming apparatus (for example, MFP) in order to carry out finishing of sheets after image formation. The sheet finishing apparatus is called finisher. The finisher punches holes in or staples sheets sent from the MFP and sorts and discharges the sheets.

The finisher has a lateral alignment board which controls the position of sheets in the direction of width. The finisher aligns the sheets in the direction of width, carries the sheets to a stapler, and staples the sheets. The lateral alignment board is also used to sort and discharge sheets. In punching a hole in sheets by using a punch unit, the skew quantity of sheets carried from the image forming apparatus is measured and a hole is punched in the sheets inclined in accordance with the skew quantity.

In the conventional finisher, when a user sets sheets in a cassette, misalignment of the sheets may occur and cause an error, or misalignment of the sheets may occur in the direction of width of the sheets at the time of image formation. Moreover, very high temperatures in forming an image on sheets may cause sheets to expand or contract and the sheets may cause an error in the direction of width. As the misalignment (error) in the direction of width of the sheets increases, the sheets collide with a tray or the like in the finisher while the sheets are carried, and cause a jam. There is also a problem that sheets fall on the lateral alignment board and cannot be aligned correctly.

The punch unit is provided with a lateral edge detection sensor which detects the position of sheets in the direction of width, and a skew sensor which measures the skew quantity of sheets. However, the lateral edge detection sensor and the skew sensor are only used in the punch unit.

JP-A-2006-273543 discloses an image forming system having an alignment unit which aligns sheets in the direction of width. JP-A-2007-193193 discloses an image forming apparatus having a detection unit which detects a sheet edge on a carrying path.

SUMMARY

Described herein relates to a sheet finishing apparatus includes:

a carrying mechanism which carries a sheet in a carrying direction;

a puncher which moves to a penetrate position where the puncher punches a hole in the sheet that is carried and to a standby position where the puncher is retreating in a direction orthogonal to the carrying direction, and punches a hole in the sheet at the penetrate position;

a detection unit which detects a lateral edge of the sheet;

a standby tray which has a pair of tray members movable in a direction orthogonal to the carrying direction and supports the sheet passed through the puncher, with the pair of tray members;

a processing tray which receives the sheet falling off the standby tray;

a finishing unit including a lateral alignment unit which has a pair of alignment boards movable in a direction orthogonal to the carrying direction and aligns the sheet on the processing tray by holding the sheet between the pair of alignment boards;

a moving mechanism which moves the position of the tray members or the alignment boards in a direction orthogonal to the carrying direction; and a control unit which measures a quantity of misalignment from the center of a carrying path of the sheet by using a result of detection of the lateral edge from the detection unit, and controls the moving mechanism in accordance with the quantity of misalignment.

DETAILED DESCRIPTION

Figure 1:
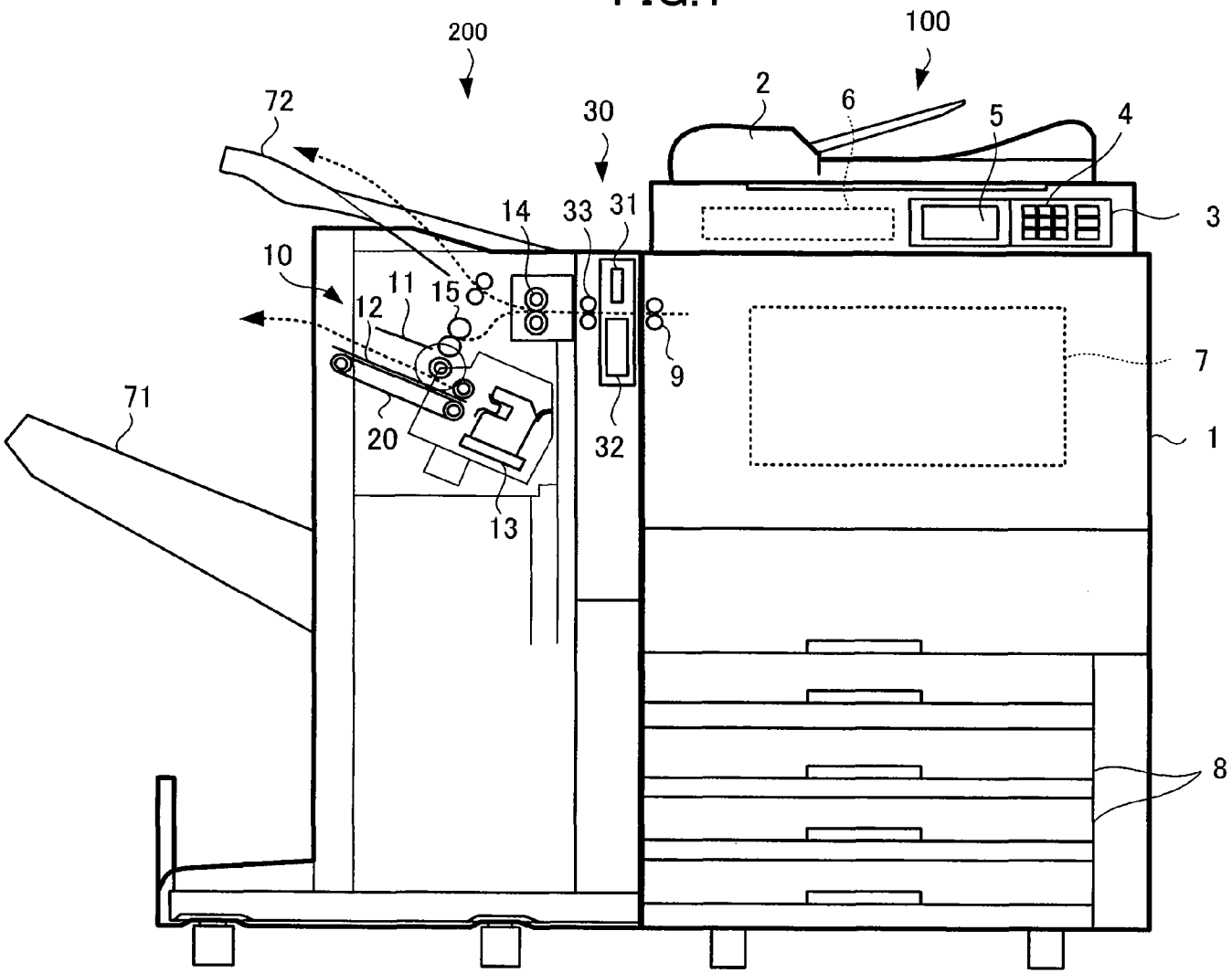
FIG. 1 is an overall configuration view showing an embodiment of a sheet finishing apparatus.

Throughout this description, the embodiments and examples shown should be considered as exemplars, rather than limitations on the apparatus of the present invention.

Hereinafter, a first embodiment of a sheet finishing apparatus will be described with reference to the drawings. In the drawings, the same parts are denoted by the same reference numerals.

FIG. 1 is a configuration view showing an image forming apparatus having a sheet finishing apparatus.

In FIG. 1, reference numeral 100 denotes an image forming apparatus, for example, a multi-function peripheral (MFP), printer or copy machine. A sheet finishing apparatus 200 is arranged next to the image forming apparatus 100. The sheet finishing apparatus 200 will be called finisher 200 hereinafter.

A sheet on which an image is formed by the image forming apparatus 100 is carried to the finisher 200. The finisher 200 carries out finishing of the sheet supplied from the image forming apparatus 100 and carries out, for example, punching, sorting, and stapling.

A document table is provided on top of a body 1 of the image forming apparatus 100. On the document table, an automatic document feeder (ADF) 2 is provided that can freely open and close. An operation panel 3 is provided on top of the body 1. The operation panel 3 has an operation unit 4 having various keys, and a touch-panel display unit 5.

A scanner unit 6 and a printer unit 7 are provided within the body 1. In a bottom part of the body 1, plural cassettes 8 housing sheets of various sizes are provided. The scanner unit 6 scans a document sent by the ADF 2 or a document placed on the document table.

The printer unit 7 includes a photoconductive drum, a laser and the like. The surface of the photoconductive drum is scanned with a laser beam from the laser and exposed to light. An electrostatic latent image is created on the photoconductive drum. A charger, a developing device, and transfer device or the like are arranged around the photoconductive drum. The electrostatic latent image on the photoconductive drum is developed by the developing device and a toner image is formed on the photoconductive drum. The toner image is transferred to the sheet by the transfer device. The configuration of the printer unit 7 is not limited to the above example and various systems can be employed.

The sheet having an image formed thereon in the body 1 is carried to the finisher 200. In the example of FIG. 1, the finisher 200 has a staple unit 10 which staples a sheet bundle, and a punch unit 30 which punches a hole in a sheet. The sheet finished by the finisher 200 is discharge to a storage tray 71 or a fixed tray 72. The storage tray 71 can move up and down.

Figure 2:
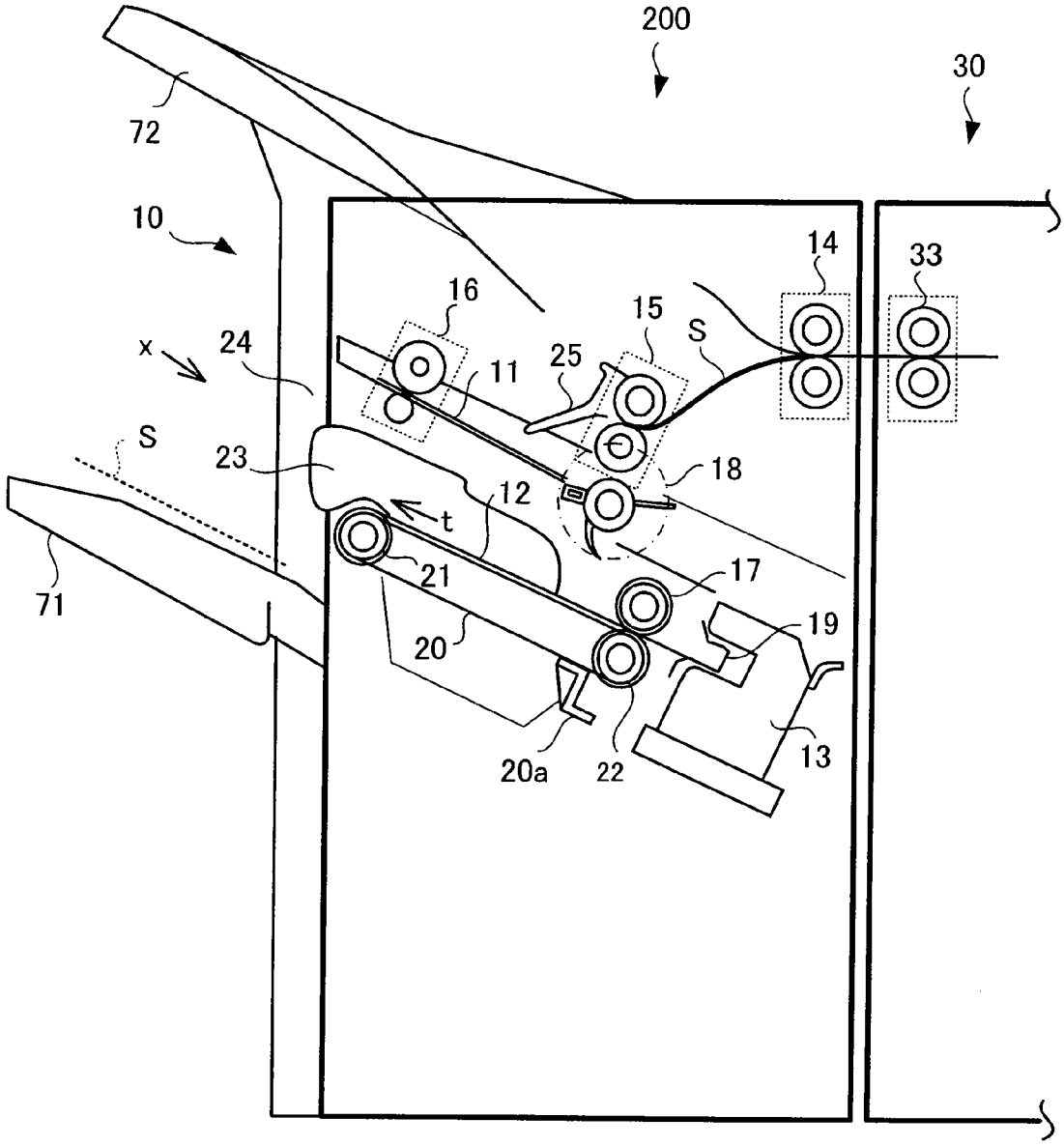
FIG. 2 is a configuration view showing a staple unit of the finisher.

FIG. 2 is a configuration view of the staple unit 10 of the finisher 200. A sheet S punched by the punch unit 30 is discharged from discharge rollers 33 and carried to the staple unit 10. The discharge rollers 33 include an upper roller and a lower roller.

The staple unit 10 has a standby tray 11, a processing tray 12, and a stapler 13. The sheet S discharged by the discharge rollers 33 of the punch unit 30 is received by entrance rollers 14 provided at the entrance of the staple unit 10. The entrance rollers 14 include an upper roller and a lower roller and are driven by a motor.

Paper supply rollers 15 are provided downstream of the entrance rollers 14. The sheet S received by the entrance rollers 14 is sent to the standby tray 11 via the paper supply rollers 15. The paper supply rollers 15 include an upper roller and a lower roller. The paper supply rollers 15 are driven by a motor. The processing tray 12 in which the sheet S falling off the standby tray 11 is stacked is arranged below the standby tray 11.

The standby tray 11 is structured to stack the sheet S and is capable of opening. As a predetermined number of sheets S are accumulated, the standby tray 11 opens and the sheets S fall onto the processing tray 12 by their own weight of the sheets or by the action of a fall assisting member which forces the sheets to fall. The processing tray 12 supports the sheets S while the sheets S are stapled by the stapler 13.

The sheets falling to the processing tray 12 are guided to the stapler 13 by a roller 17 and become stapled. The roller 17 is driven by a motor. The roller 17 rotates in the opposite directions when guiding the sheets S into the direction of the stapler 13 and when discharging the stapled sheets S.

When stapling, the plural sheets S falling off the standby tray 11 to the processing tray 12 are aligned longitudinally, that is in the carrying direction, and aligned laterally, that is in a direction orthogonal to the carrying direction, and the plural sheets S are stapled. A lateral alignment unit 23 is provided in order to laterally align the sheets S. The lateral alignment unit 23 aligns and sorts the sheets S (which will be described in detail later).

The stapler 13 and the lateral alignment unit 23 constitute a finishing unit in the staple unit 10 and carry out finishing such as stapling and sorting.

In order to help the sheets S fall onto the processing tray 12, a rotatable paddle 18 is provided at the position which the rear edge of the sheets S falls to reach. The paddle 18 is attached to a rotary shaft. The paddle 18 strikes the sheet S falling off the standby tray 11, onto the processing tray 12, and sends the sheet-S into the direction of the stapler 13.

At the edge of the processing tray 12 close to the stapler 13, a stopper 19 is provided which regulates the rear edge position of the sheets S. Moreover, a carrying belt 20 is provided in order to carry the sorted or stapled sheets S to the storage tray 71. The carrying belt 20 is laid between pulleys 21 and 22. A pawl member 20*a* for catching and sending the rear edge of the sheets S is attached to the carrying belt 20. The description of a mechanism for rotating the pulleys 21 and 22 is omitted.

As the carrying belt 20 turns in the direction of arrow t, the sheets S are discharged from a discharge port 24 to the storage tray 71. The storage tray 71 rises and falls through a motor and receives the sheets S. The carrying belt 20 and the pawl member 20*a* constitute a sheet discharge unit for guiding the stapled sheets S to the discharge port 24.

When discharging the sheets S stacked on the standby tray 11 to the storage tray 71 without stapling the sheets S, the sheets S are discharged by a rotary roller 16 without causing the sheets S to fall onto the processing tray 12. Sheets S that do not need stapling can be discharged to the fixed tray 72. A carrying path for guiding the sheets S to the fixed tray 72 is provided. An assist arm 25 is attached to the attachment shaft of the upper roller of the paper supply rollers 15 in such a manner that the assist arm 25 can fluctuate. The assist arm 25 protrudes to the discharge side of the paper supply rollers 15 and adapted to press the sheets S to the standby tray 11 in order to prevent floating of the rear edge side of the sheets S discharged from the paper supply rollers 15.

Figure 3:
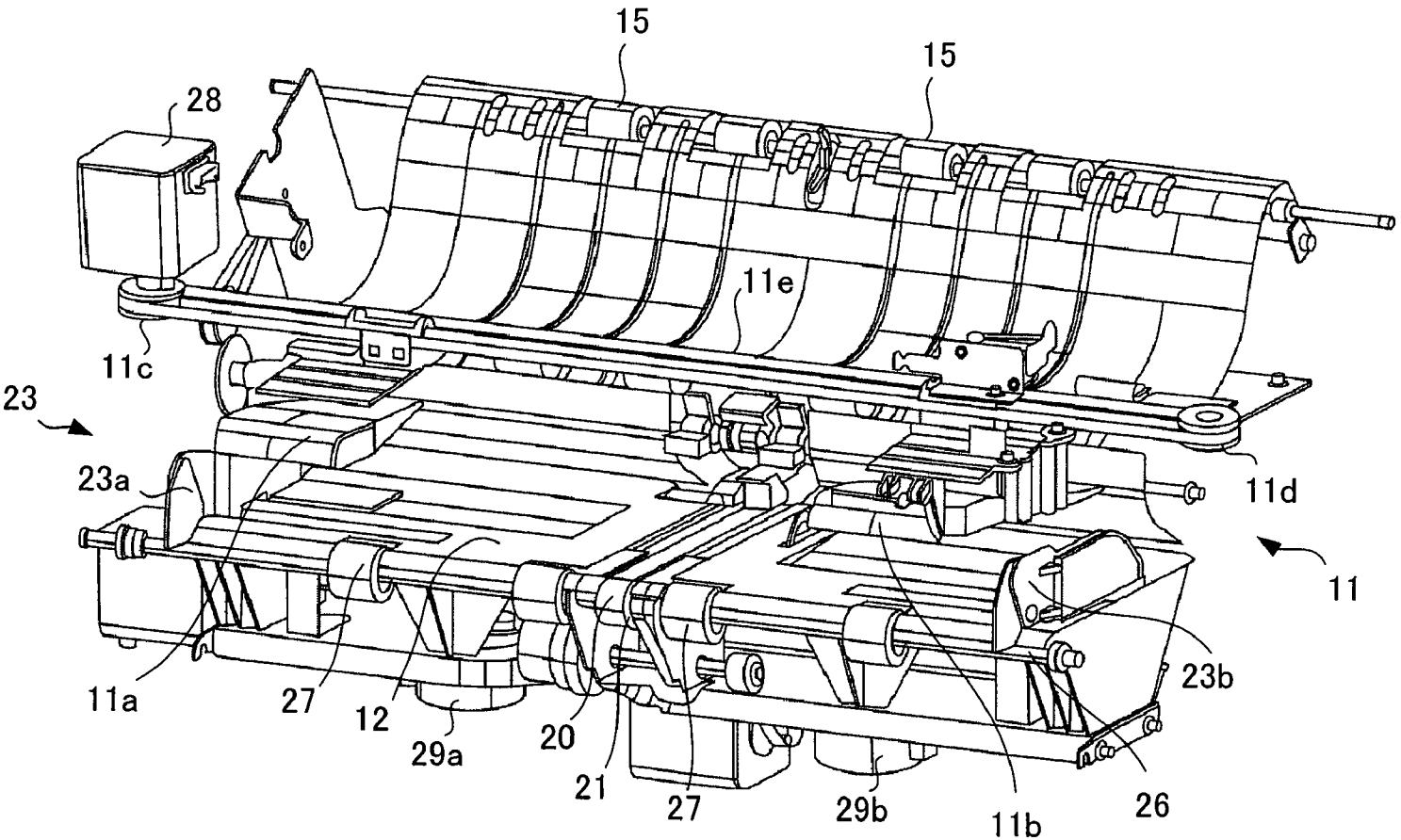
FIG. 3 is a perspective view showing the configuration of a standby tray and a lateral alignment unit of the finisher.

FIG. 3 is a perspective view of essential parts of the staple unit 10, as viewed from the direction of arrow x in FIG. 2. In FIG. 3, mainly the mechanism around the standby tray 11 and the processing tray 12 is shown.

In FIG. 3, a shaft 26 is arranged orthogonally to the carrying direction of the sheet S. The pulley 21 is attached to an intermediate part of the shaft 26. The carrying belt 20 is laid over the pulley 21. The carrying belt 20 is laid between the pulley 21 and the pulley 22 (FIG. 2). The carrying belt 20 is turned by a motor and circularly turns between the stapler 13 and the discharge port 24 along the sheet discharging direction. Discharge rollers 27 are attached to a center part and both sides of the shaft 26 and rotate when discharging the sheets S to the storage tray 71.

The standby tray 11 has a pair of tray members 11*a* and 11*b* and supports both ends of the sheet S in the direction of width. The processing tray 12 is provided with the lateral alignment unit 23. The lateral alignment unit 23 includes a pair of alignment boards 23*a* and 23*b* provided on both sides of the processing tray 12. The tray members 11*a* and 11*b* and the alignment boards 23*a* and 23*b* are slidable in the direction of width of the sheet. The alignment boards 23*a* and 23*b* align the sheet falling off the tray members 11*a* and 11*b*.

Figure 4:
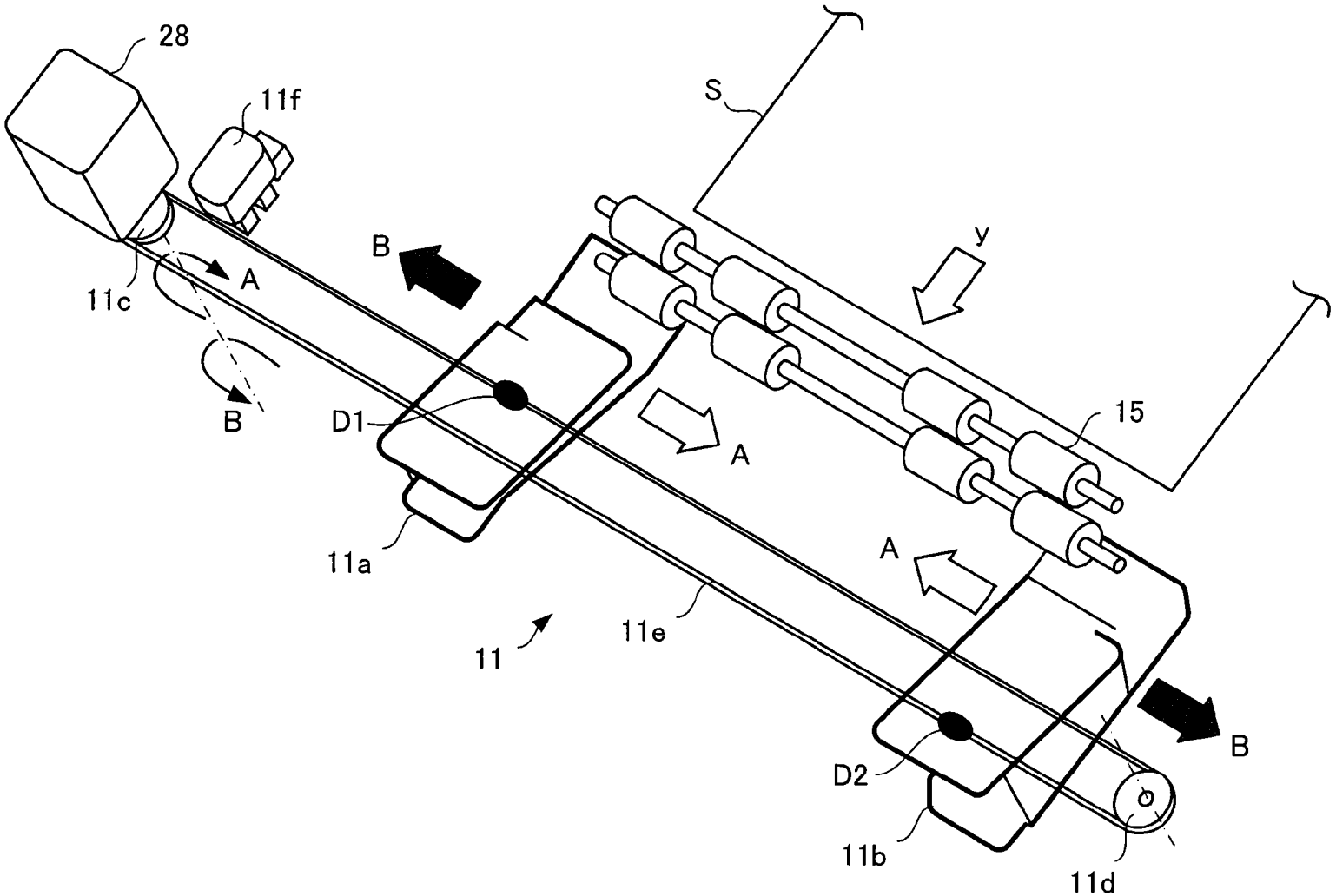
FIG. 4 is a perspective view schematically describing the configuration of the standby tray.
Figure 5:
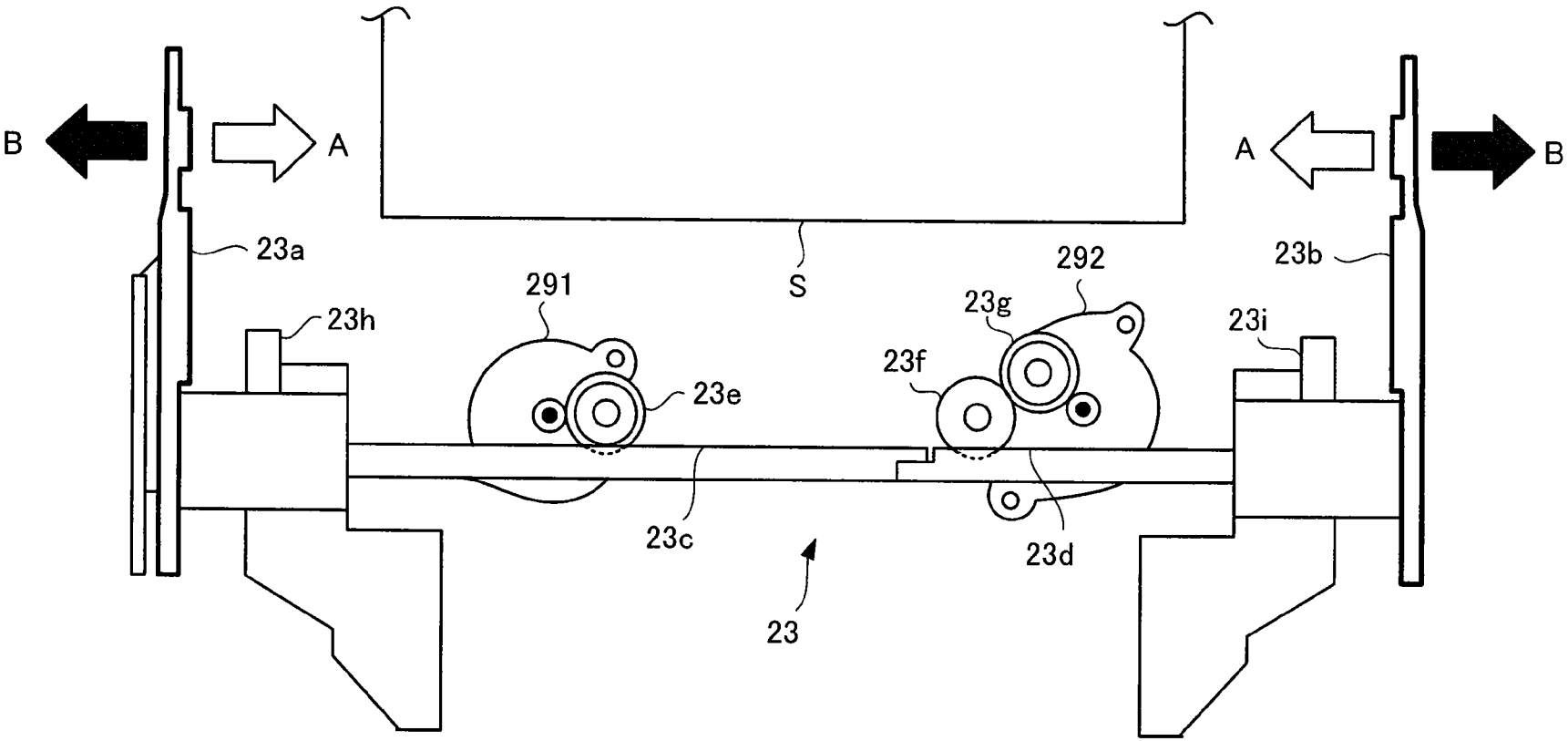
FIG. 5 is a plan view showing the configuration of the lateral alignment unit.

FIG. 4 is a perspective view showing the schematic configuration and operation of the standby tray 11. FIG. 5 is a plan view showing the configuration and operation of the lateral alignment unit 23.

In FIG. 4, the standby tray 11 has the pair of tray members 11*a* and 11*b*, and a timing belt 11*e* laid between pulleys 11*c* and 11*d*. The pulley 11*c* is rotated by the rotation of a motor 28 and the timing belt 11*e* is turned in the direction of arrow A or in the direction of arrow B.

The loop of the timing belt 11*e* is connected to the tray members 11*a* and 11*b* (with the connecting points indicated by dots D1 and D2). As the timing belt 11*e* turns, the tray members 11*a* and 11*b* move in a direction toward each other (direction A) or in a direction away from each other (direction B). That is, the tray members 11*a* and 11*b* move in a direction orthogonal to the carrying direction y of the sheet S. The direction of arrow A indicates an inward direction in which the tray members 11*a* and 11*b* move toward the sheet carrying path. The direction of arrow B indicates an outward direction in which the tray members 11*a* and 11*b* move away from the sheet carrying path.

The tray members 11*a* and 11*b* move in the direction of arrow A, stand by at a sheet holding position that is defined by sheet size, and receive the sheet. Plural sheets S can be stacked on the tray members 11*a* and 11*b*. While sheets on the processing tray 12 of FIG. 2 are stapled, sheets discharged from the image forming apparatus 100 are supported by the tray members 11*a* and 11*b*.

As the sheets on the processing tray 12 are discharged to the storage tray 71, the tray members 11*a* and 11*b* move in the direction of arrow B and let the supported sheets fall onto the processing tray 12.

A sensor 11*f* is provided near the motor 28. The sensor 11*f* detects whether the tray members 11*a* and 11*b* are at their home position or not.

The home position of the tray members 11*a* and 11*b* is, for example, a predetermined position moved in direction B. The tray members 11*a* and 11*b* are moved in the direction of arrow A from the home position according to the sheet size. If a stepping motor is used as the motor 28, the moving distance of the tray members 11*a* and 11*b* is possible to set by managing the number of rotations of the motor 28, that is, the number of pulses.

Meanwhile, when the sheets S fall to be supplied from the standby tray 11 to the processing tray 12, the sheets S may become irregular in a direction orthogonal to the carrying direction (direction of width).

The lateral alignment unit 23 of FIG. 5 is to prevent the irregularity in the direction of width of the sheets S. The lateral alignment unit 23 has the pair of alignment boards 23*a* and 23*b* arranged on both side of the processing tray 12, racks 23*c* and 23*d* coupled with the alignment boards 23*a* and 23*b*, and gears 23*e* and 23*f* meshing with the racks 23*c* and 23*d*.

Motors 291 and 292 are provided in order to rotate the gears 23*e* and 23*f*. The rotation of the motor 291 causes the gear 23*e* to rotate, move the rack 23*c* and move the alignment board 23*a* in the direction of arrow A or arrow B. A gear 23*g* is provided between the motor 292 and the gear 23*f*. The rotation of the motor 292 causes the gear 23*g* and the gear 23*f* to rotate, move the rack 23*d* and move the alignment board 23*b* in the direction of the arrow A or arrow B. The alignment boards 23*a* and 23*b* move separately from each other in the direction orthogonal to the sheet carrying direction.

Sensors 23*h* and 23*i* are provided near the alignment boards 23*a* and 23*b*, respectively, and detect the home position of the alignment boards 23*a* and 23*b*. The home position of the alignment boards 23*a* and 23*b* is, for example, a predetermined position moved in direction B. The alignment boards 23*a* and 23*b* are moved in the direction of arrow A from the home position according to the sheet size. If stepping motors are used as the motors 291 and 292, the moving distance of the alignment boards 23*a* and 23*b* is possible to set by managing the number of rotations of the motors 291 and 292, that is, the number of pulses.

The motor 28 and the timing belt 11*e* shown in FIG. 4, and the motors 291 and 292, the racks 23*c* and 23*d*, and the gears 23*e*, 23*f* and 23*g* shown in FIG. 5 constitute a moving mechanism for moving the position of the tray members 11*a* and 11*b* and of the alignment boards 23*a* and 23*b* in the direction orthogonal to the carrying direction y of the sheet.

The lateral alignment unit 23 is used for the function of aligning the position of the sheet in the direction of width and for the function of sorting and discharging the sheet, the functions of sorting and discharging of the sheet will be described in detail later.

Next, the punch unit 30 will be described. As shown in FIG. 1, the punch unit 30 is arranged between the body 1 of the image forming apparatus 100 and the staple unit 10 and has a punch box 31 and a dust box 32.

The punch box 31 has a punching blade which punches a sheet. The punching blade moves down to punch a hole in a sheet. Punch dust generated by punching falls into the dust box 32.

In the path from the body 1 to the staple unit 10, there are rollers 9 and rollers 33 for carrying a sheet. The rollers 9 are supported by the body 1. The rollers 33 are located at the final exit of the punch unit 30. A sheet discharged from the body 1 is carried to the punch unit 30 by the rollers 9 and is carried to the staple unit 10 by the rollers 33.

The rollers 9 and 33 constitute a carrying mechanism that carries the sheet S supplied from the image forming apparatus 100, in the carrying direction. The punching by the punch unit 30 is carried out when the punch mode is set by the user operating the operation panel 3.

Figure 6:
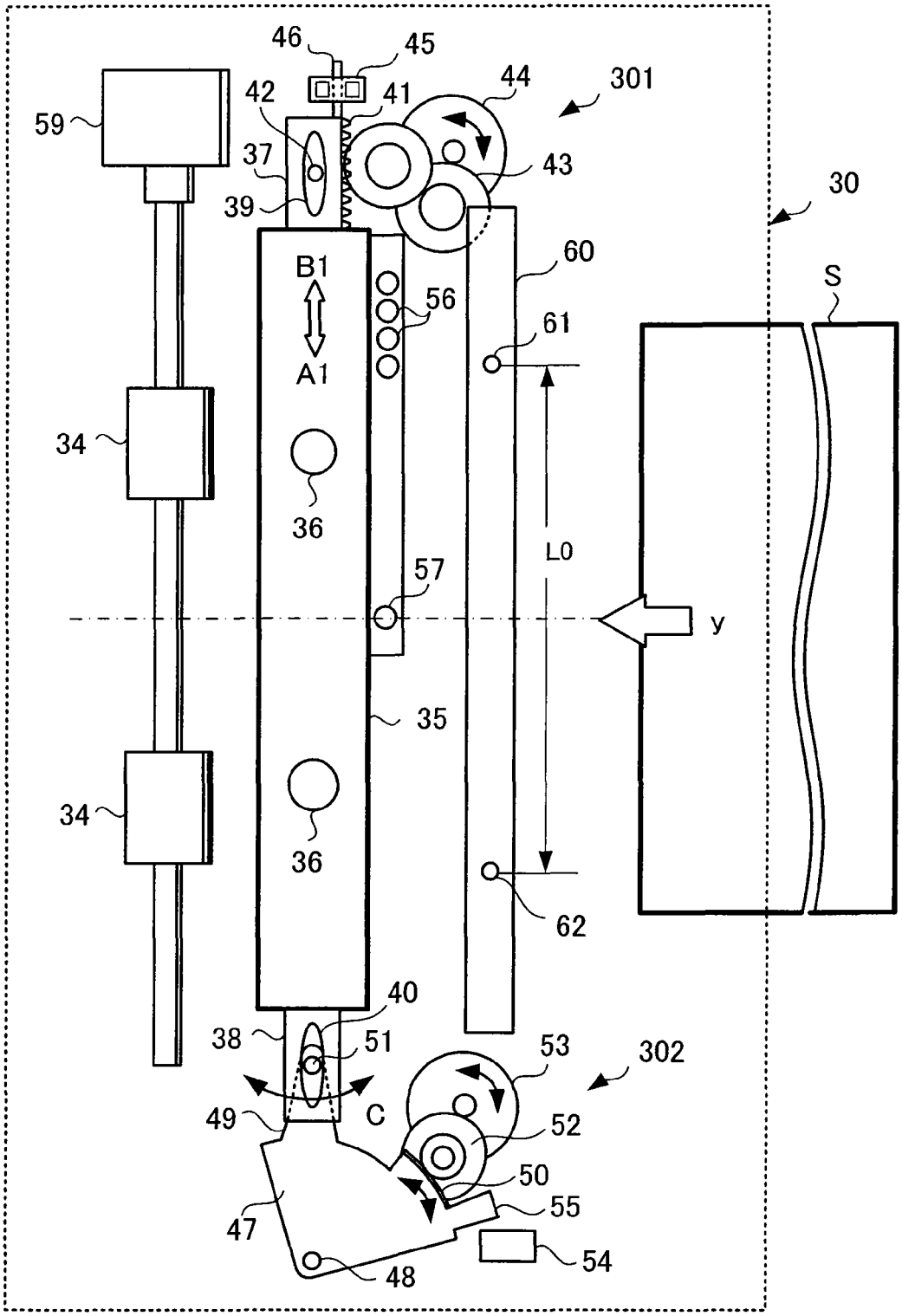
FIG. 6 is a plan view showing the configuration of a punch unit of the finisher.

FIG. 6 shows the specific configuration of the punch unit 30.

The punch unit 30 has the function of punching a hole in the sheet S and the function of correcting the skew of the sheet S. The punch unit 30 has a puncher 35 which punches a hole in the sheet S carried in from the body 1, and a skew detection unit 60 which detects the skew. The puncher 35 is provided downstream of the skew detection unit 60.

Figure 9:
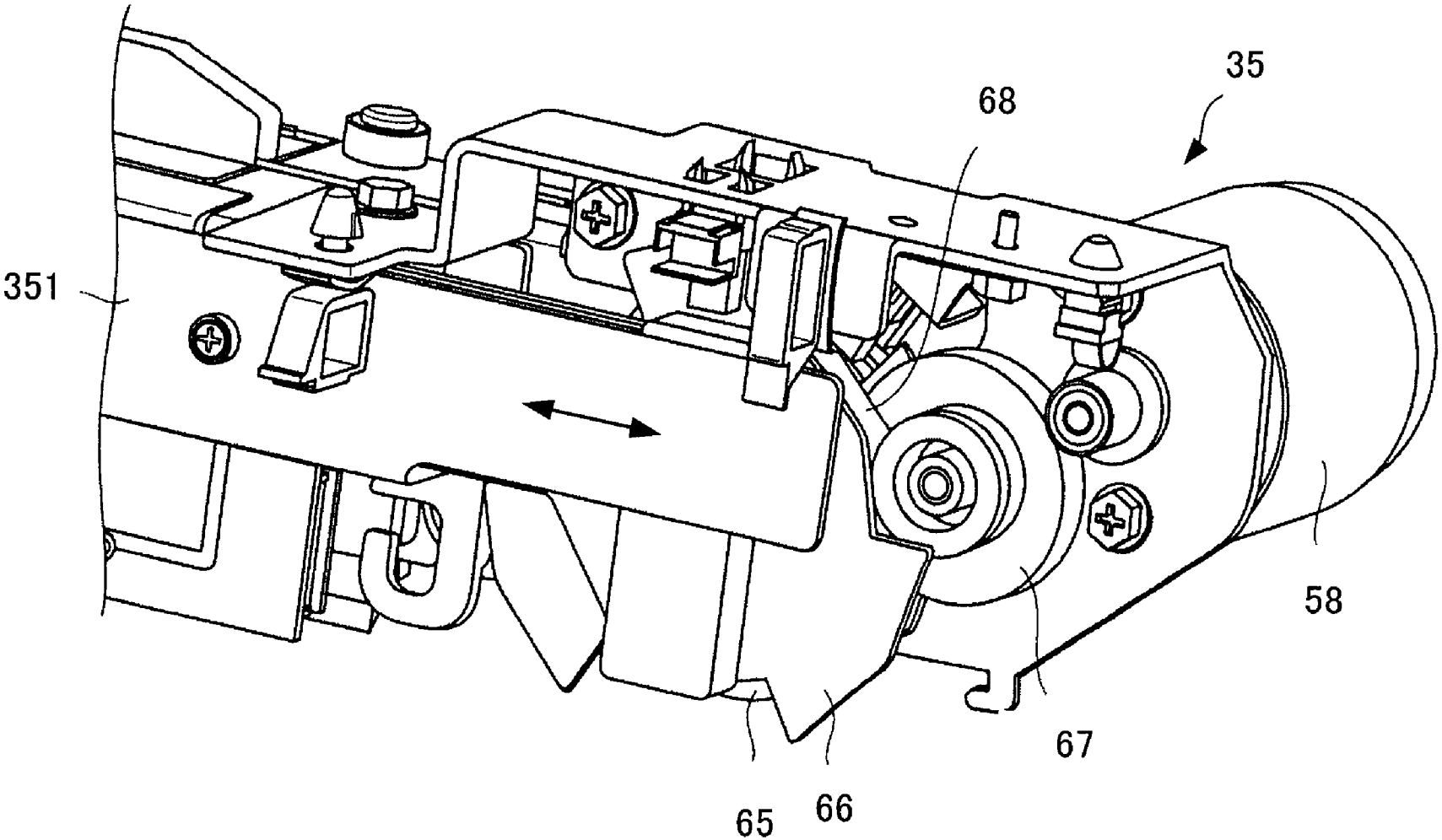
FIG. 9 is a perspective view showing a driving unit of the punch unit.

The skew detection unit 60 and the puncher 35 are orthogonal to the carrying direction y of the sheet S. The puncher 35 has plural (in FIG. 6, two) punching blades 36. The punching blades 36 are moved up and down by the rotation of a punch motor 58 (FIG. 9). The punching blades 36 move down toward the sheet surface of the sheet S and punch holes in the sheet S. The elevator mechanism of the punching blades 36 is generally known.

The puncher 35 can move in the direction of arrows A1-B1 (lateral direction) orthogonal to the carrying direction y of the sheet S. One edge (the lower edge in FIG. 6) of the puncher 35 rotates in the direction of arrow C (longitudinal direction) along the carrying direction of the sheet S.

At both ends of the puncher 35 in the axial direction, protruding pieces 37 and 38 are provided. Slots 39 and 40 are formed in the protruding pieces 37 and 38, respectively. A rack 41 is formed on the lateral side of the one protruding piece 37. A fixed shaft 42 provided on the body side of the finisher 200 is fitted in the slot 39 of the protruding piece 37. The puncher 35 can move in the direction of arrows A1-B1 within the length of the slot 39 by using the fixed shaft 42 as a guide.

A gear group 43 meshing with the rack 41 and rotating moves the puncher 35 laterally (in the direction of arrow A1-B1). A lateral registration motor 44 rotates the gear group 43.

A sensor 45 is provided at a position away from the protruding piece 37. The sensor 45 detects that the puncher 35 moves in the direction of arrows A1-B1 and reaches home position of the puncher 35. The protruding piece 37 is provided with a shutter 46 extending in the direction of the sensor 45. As the shutter 46 traverses the sensor 45, the sensor 45 detects that the puncher 35 is moved to the home position in the direction of arrows A1-B1.

A sectoral cam 47 which allows the puncher 35 to rotate in the direction of arrow C is coupled with the protruding piece 38 of the puncher 35. The cam 47 swivels around a shaft 48 as the fulcrum which is provided on the body side of the finisher 200. At one end of the cam 47 has a lever 49 and at other end of the cam 47 has a gear 50 formed. The lever 49 is provided with a shaft 51. The shaft 51 is fitted in the slot 40 of the protruding piece 38.

To rotate puncher 35 in the longitudinal direction (direction C), a gear group 52 which rotates by meshing with the gear 50 is provided, and a longitudinal registration motor 53 which rotates the gear group 52 is provided. The rotation of the longitudinal registration motor 53 causes the cam 47 to rotate. The rotation of the cam 47 causes the lever 49 to rotate and the puncher 35 rotates in the longitudinal direction (direction C) about the fixed shaft 42 as the fulcrum.

A sensor 54 is located at a position away from the cam 47. The sensor 54 detects that the puncher 35 rotates in the direction of arrow C and rotates to the home position. On the cam 47, a shutter 55 is formed which extends in the direction of the sensor 54. As the shutter 55 traverses the sensor 54, the sensor 54 detects that the puncher 35 is rotated to the home position.

As described above, the puncher 35 is moved laterally (in direction A1-B1) by the rotation of the lateral registration motor 44 and is rotated longitudinally (in direction C) by the longitudinal registration motor 53.

The moving mechanism for moving the puncher 35 laterally (in the direction of arrows A1-B1) is denoted by 301. The posture control mechanism for rotating the puncher 35 longitudinally (in the direction of arrow C) and controlling posture of the puncher 35 is denoted by 302.

For the lateral registration motor 44 and the longitudinal registration motor 53, stepping motors capable of controlling the number of rotations by the number of pulses or frequency may be used. The moving distance in the lateral direction of the puncher 35 can be managed by the number of pulses in driving the lateral registration motor 44. The rotation control of the puncher 35, that is, angle of the puncher 35 can be managed by the number of pulses in driving the longitudinal registration motor 53.

On the sheet S carry-in side of the puncher 35, a sensor group 56 which detects the edge of the sheet S in the lateral direction (lateral edge), and a sensor 57 which detects the edges in the longitudinal direction (forward edge and rear edge) when the sheet S is carried, are provided.

In the sensor group 56 and the sensor 57, for example, a light emitting element and a light receiving element are arranged to face each other. When the sheet S is carried, as the sheet S passes between the light emitting element and the light receiving element, the sensor group 56 and the sensor 57 detect the lateral edge, the forward edge and the rear edge of the sheet S.

The skew detection unit 60 has sensors 61 and 62 for skew detection. Also the sensors 61 and 62 include, for example, a light emitting element and a light receiving element that faces the light emitting element. The sensors 61 and 62 detect the skew of the sheet S passing between the light emitting element and the light receiving element.

The sensors 61 and 62 are located upstream of the punch unit 30. The sensors 61 and 62 detect the passing of the forward edge and the rear edge of the sheet S. The sensor 61 and the sensor 62 are arrayed in a direction orthogonal to the sheet carrying direction and away from each other by a distance L0.

Detection signals from the sensors 61 and 62 are sent to a control unit 201, which will be described later. The control unit 201 has a timer counter. The timer counter starts timing when the sensors 61 and 62 detect the passing of the forward edge of the sheet S. If the sheet S is not inclined at all with respect to the carrying direction, the sensors 61 and 62 simultaneously detect the passing of the forward edge of the sheet S. The timer counters simultaneously start counting and no time difference occurs.

If the sheet S is carried in an inclined state, the passing of the sheet S detected by the first sensor 61 and the second sensor 62 has a time difference. Therefore the skew detection unit 60 can be understood that the sheet S is skewed.

A skew error distance (a) can be calculated from the difference between the time when the sensor 61 detects the sheet S and the time when the sensor 62 detects the sheet S, and the carrying speed V of the sheet S. If the distance between the first sensor 61 and the second sensor 62 is L0 and the skew angle is (θ), the following equation (1) holds.

$$a = L0 \times \tan\theta \quad (1)$$

As the skew angle θ is calculated from the equation (1), the longitudinal registration motor 53 is rotated by the angle θ and the puncher 35 is inclined and skew correction is carried out in accordance with the skew quantity of the sheet.

Carrying rollers 34 are driven by a carrying motor 59 and carry the sheet S carried from the upstream side in the carrying path (the entrance side to the punch unit 30), to the downstream side (the exit side of the punch unit 30). As the carrying motor 59, for example, a stepping motor is used. The carrying motor 59 rotates at a predetermined number of rotations.

The basic operation of the punch unit 30 will be described with reference to FIG. 7A, FIG. 7B, FIG. 8A and FIG. 8B. FIG. 7A shows the initial state of the punch unit 30. As an instruction to punch is received from the body 1, the control unit 201 (which will be described later) drives the longitudinal registration motor 53 to set the puncher 35 in a state of being rotated and inclined in the direction of arrow C1 along the carrying direction of the sheet S. The state of being rotated and inclined in the direction of arrow C1 is the home position in the longitudinal direction.

The control unit 201 also drives the lateral registration motor 44 to move the puncher 35 in the direction of arrow B1 intersecting the carrying direction of the sheet S by using the gear group 43 and set the puncher 35 to a retreating position.

As the sheet S is carried in, the skew quantity of the forward edge of the sheet S is detected by the skew detection unit 60. As the skew quantity is detected, the control unit 201 drives the longitudinal registration motor 53 to incline the puncher 35 in the direction of arrow C2 in accordance with the skew quantity of the sheet S, as shown in FIG. 7B.

Figure 7B:
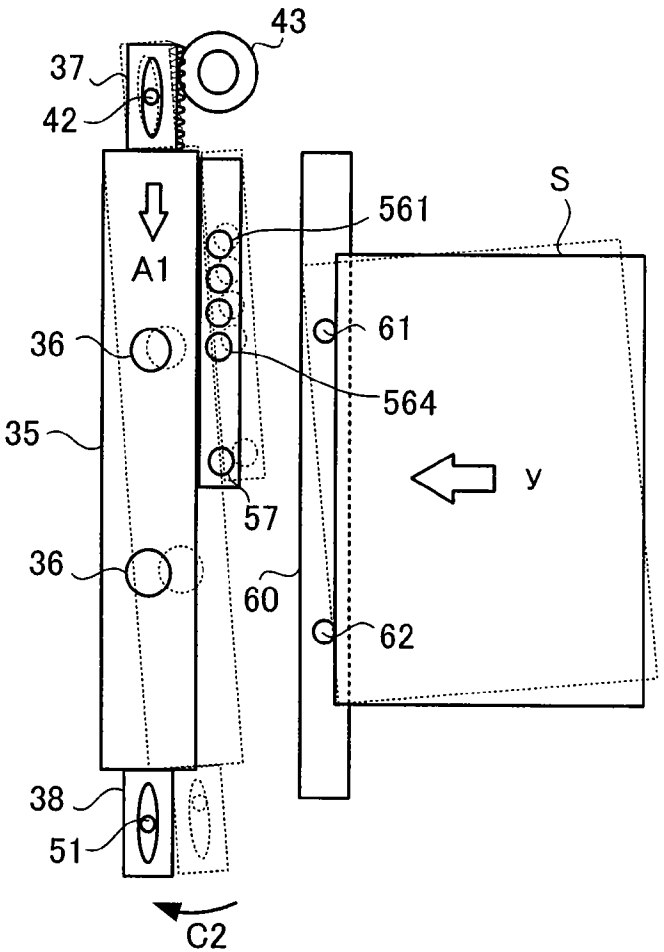
FIG. 7A, FIG. 7B, FIG. 8A and FIG. 8B are plan views showing the basic operation of the punch unit.
Figure 7A:
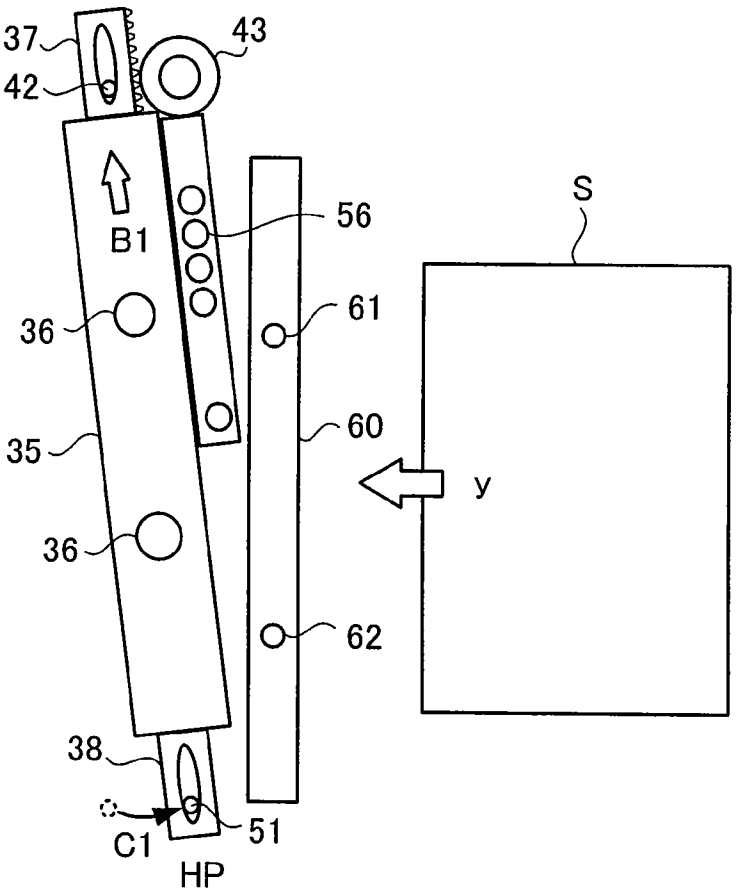

The fine dotted line in FIG. 7B shows the state where the puncher 35 is inclined in accordance with the skewed sheet S. If the sheet S is not skewed, the puncher 35 is orthogonal to the carrying direction of the sheet S as indicated by the solid line.

When the forward edge of the sheet S is detected by the sensor 57 after the sheet S is carried by a prescribed amount, the lateral registration motor 44 is driven to move the puncher 35 in the direction of arrow A1 toward the center of the carrying path from the retreating position. When the puncher 35 moves in direction A1, the sensor group 56 detects the lateral edge of the sheet S along the carrying direction.

In the detection of the lateral edge, one of the sensors of the sensor group 56 is designated in accordance with the sheet size designated from the operation panel 3, and the lateral edge is detected by the designated sensor. For example, the lateral edge of A4-size is detected by using an outer sensor 561. If the sheet size is smaller, an inner sensor 564 is used to detect the lateral edge. AS the lateral edge is detected by one of the sensors of the sensor group 56 the lateral registration motor 44 stops and the puncher 35 stops moving, too.

Figure 8B:
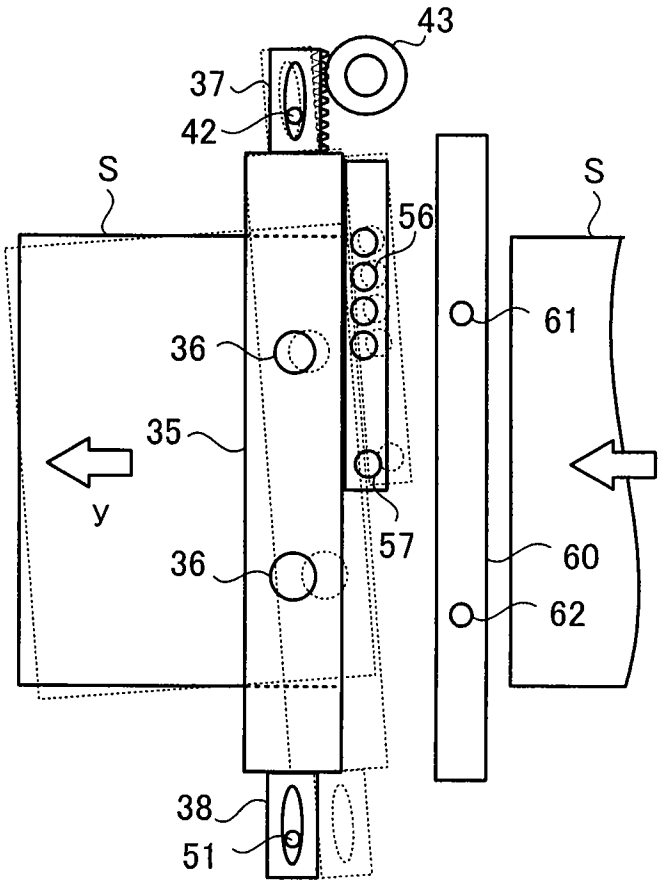
Figure 8A:
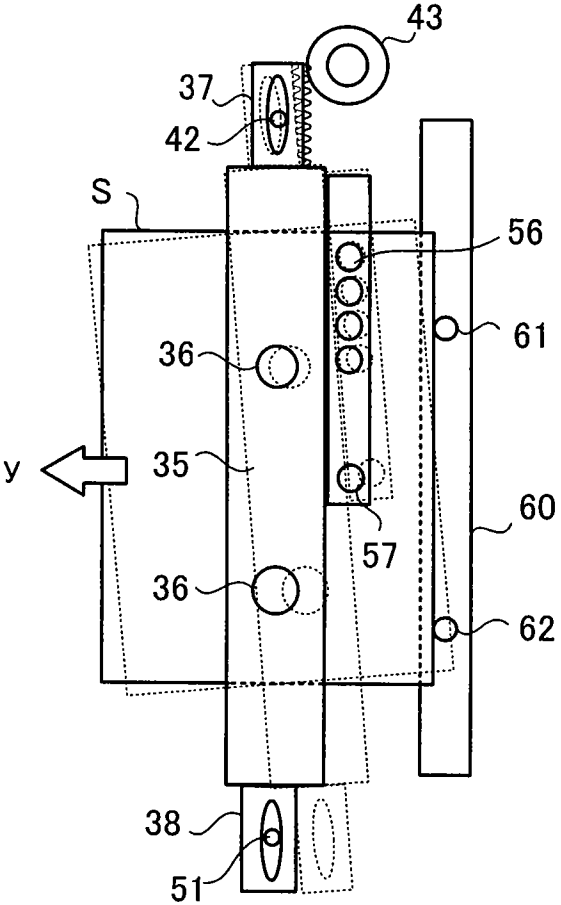

As the sheet S is carried further, the skew quantity of the rear edge of the sheet S is detected by the skew detection unit 60, as shown in FIG. 8A. If there is a difference between the skew quantity of the forward edge and the skew quantity of the rear edge, the longitudinal registration motor 53 is driven to make fine adjustment of the inclination of the puncher 35 by the amount of the difference. If the lateral edge of the sheet S is misaligned, the lateral registration motor 44 is driven to make fine adjustment of the lateral position of the puncher 35.

As shown in FIG. 8B, after the rear edge of the sheet S is detected by the sensor 57, the sheet S is carried from the position where the rear edge is detected to a prescribed position where punching is carried out, and carrying motor 59 stops. In the state where the carrying motor 59 is stopped, the punch motor 58 is driven to lower the punching blades 36 and punch holes in the sheet S.

The driving of the punch motor 58 may be started in earlier timing than when the carrying motor 59 stops, in consideration of the time taken until the punching blades 36 contact the sheet. If the driving is to start in earlier timing, the punch motor 58 starts to be driven with the lapse of a preset time after the rear edge of the sheet S is detected by the sensor 57.

As the punching of holes is finished, the control unit 201 drives the carrying motor 59 again to discharge the punched sheet. If there is a next sheet, the operation of FIG. 7A to FIG. 8B is repeated. If there is no subsequent sheet, each device is set to the home position (HP) and the operation ends.

FIG. 9 is a perspective view showing a part of the puncher 35 as enlarged. The puncher 35 has the plural punching blades 36 (see FIG. 6) to carrying out punching. The punching blades 36 are driven up and down in accordance with the sliding of a slide link 351. The slide link 351 is driven by the punch motor 58. The structure of driving the punching blades 36 by using the slide link 351 is a generally known technique.

The puncher 35 also has a home position detection unit 65 which detects the home position (standby position) of the punching blades 36, a trigger unit 66 which generates a trigger for driving and stopping the punch motor 58, a gear 67, a crank gear 68 and the like. The gear 67 and the crank gear 68 transmit the rotation of the punch motor 58 to the slide link 351.

The operation of the puncher 35 shown in FIG. 9 will now be schematically described. As the carried sheet S enters the puncher 35, the punch motor 58 alternately repeats forward rotation and backward rotation by half turn each and slides the slide link 351 to left and right.

The sliding of the slide link 351 causes the punching blades 36 to move up and down and punch holes in the sheet S. That is, as the punch motor 58 is driven by half turn, the first round of punching is carried out. As the punch motor 58 is rotationally driven in the reverse direction, punching is carried out to the next sheet.

There is a puncher that carries out one round of punching as the punch motor 58 rotates by one turn. In the puncher that carries out one round of punching as the punch motor 58 rotates by one turn, the punch motor 58 only rotates in one direction and repeats punching. As the puncher 35, there are also punchers for punching two hole or four holes.

The control system of the finisher 200 will be described with reference to the block diagram of FIG. 10.

Figure 10:
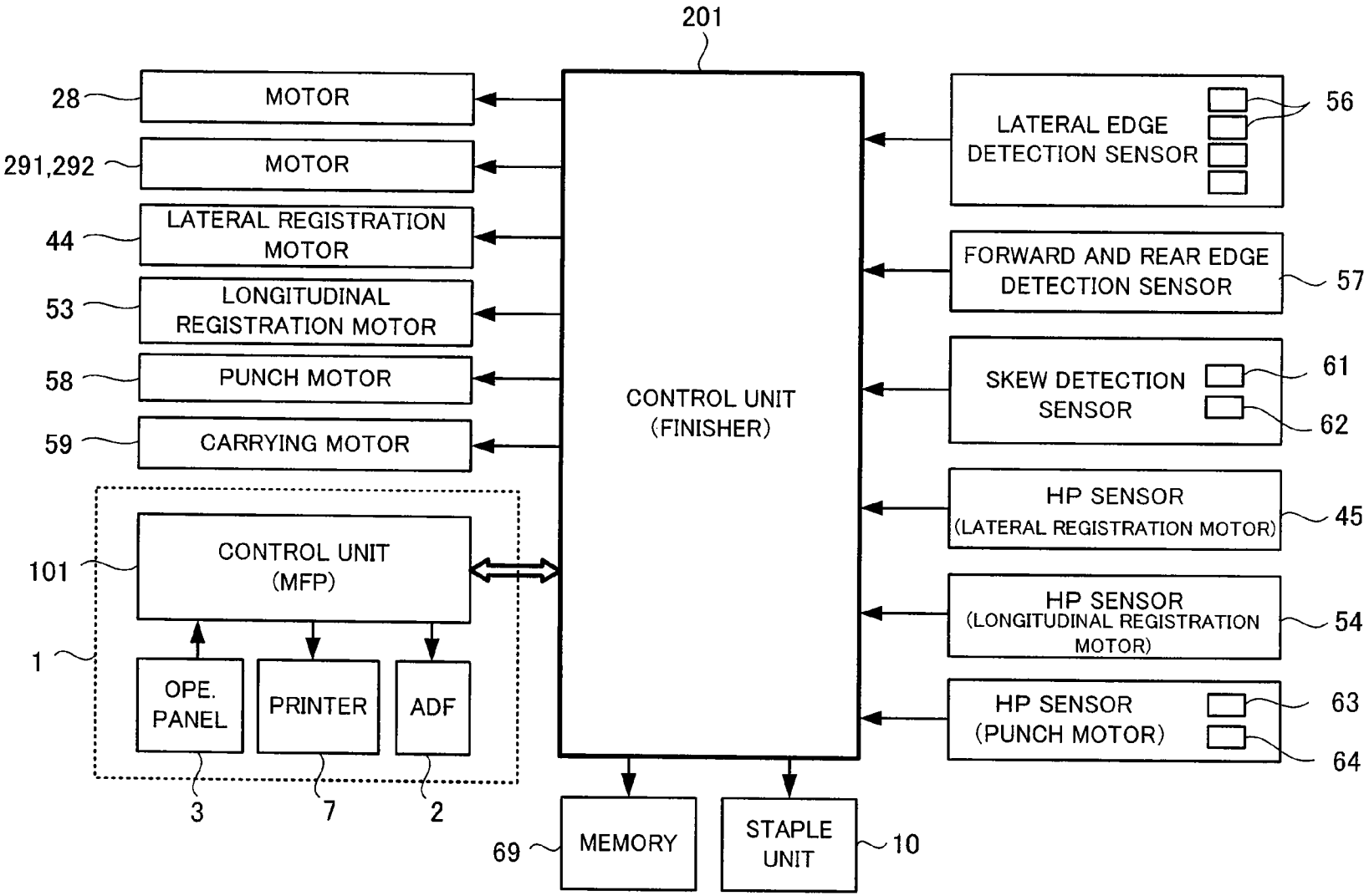
FIG. 10 is a block diagram showing a control system of the finisher.

In FIG. 10, 201 represents the control unit which controls the finisher 200. The control unit 201 includes a CPU (central processing unit), a RAM, a ROM and the like. The lateral edge detection sensor group 56, the sensor 57 for detecting the forward edge and rear edge of the sheet S, the skew detection sensors 61 and 62, and the home position sensors 45, 54, 63 and 64 are connected to the control unit 201. The results of detection from the sensors are inputted to the control unit 201. Also, a memory 69 is connected to the control unit 201.

Moreover, the motor 28 which drives the tray members 11*a* and 11*b*, the motors 291 and 292 which drive the alignment boards 23*a* and 23*b*, the lateral registration motor 44, the longitudinal registration motor 53, the punch motor 58, and the carrying motor 59 are connected to the control unit 201. The control unit 201 controls the rotation of each motor in response to the results of detection from the above various sensors.

The home position sensor 45 detects the home position when the puncher 35 is moved laterally (in direction A1-B1) by the lateral registration motor 44. The home position in the lateral direction is the center part in the carrying path of the sheet S and is equivalent to the penetrate position.

The home position sensor 54 detects the home position when the puncher 35 is rotated longitudinally (in direction C) by the longitudinal registration motor 53. The home position in the longitudinal direction is the position shown in FIG. 7A where the puncher 35 is inclined to the maximum.

The home position sensors 63 and 64 detect the home position when the punching blades 36 are moved up and down by the punch motor 58. The home position of the punching blades 36 is the state where the punching blades 36 are pulled out of the sheet S, that is, the standby position where the punching blades 36 are away from the sheet surface of the sheet S.

The control unit 201 is connected to a control unit 101 which controls the body (MFP) 1. Each unit of the body 1, for example, the operation panel 3, the printer unit 7, the ADF 2 and the like are connected to the control unit 101. The control unit 201 also controls the staple unit 10. The control unit 201 and the control unit 101 operate in an interlocked manner and give instructions to staple and punch in accordance with the operation of the operation panel 3. The control unit 201 and the control unit 101 designate the sheet size, designate the number of copy sheets, input the sheet type and so on in accordance with the operation of the operation panel 3.

Figure 11A:
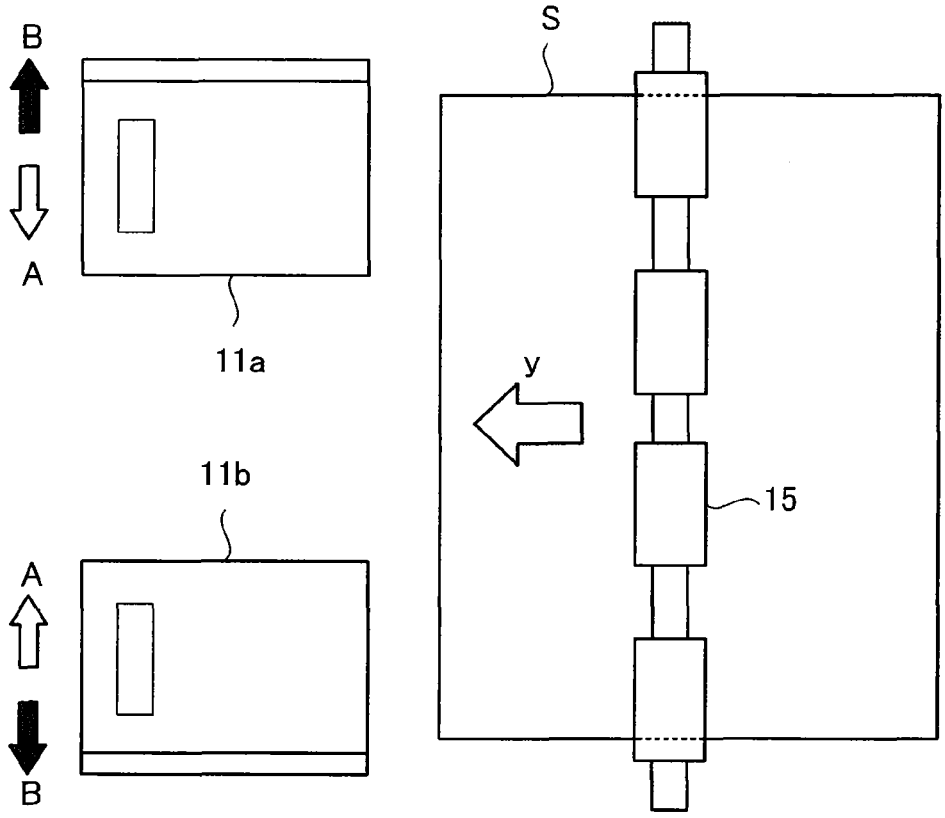
FIG. 11A and FIG. 11B are plan view and front view showing the basic operation of the standby tray and the lateral alignment unit.
Figure 11B:
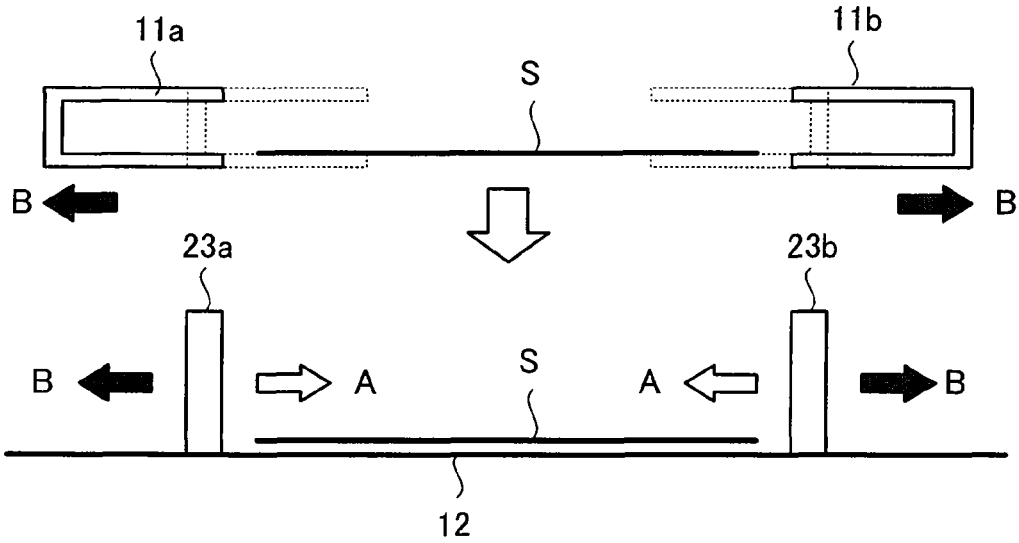

FIG. 11A is a plan view showing the operation of the standby tray 11. FIG. 11B is a front view showing the operation of the standby tray 11 and the lateral alignment unit 23, as viewed from the direction of arrow x in FIG. 2.

As shown in FIG. 11A, the tray members 11*a* and 11*b* of the standby tray 11 are movable in the direction of arrow A or arrow B, which is orthogonal to the carrying direction y of the sheet that is carried in. The carried sheet S is received and supported by the tray members 11*a* and 11*b*. The tray members 11*a* and 11*b* have a U-shaped cross section (see FIG. 11B). When the tray members 11*a* and 11*b* are situated at the position indicated by the dotted lines in FIG. 11B (first position), the tray members 11*a* and 11*b* support the sheet S. As the tray members 11*a* and 11*b* move to the position in direction B (second position), the sheet S falls onto the processing tray 12.

When the sheet S falls onto the processing tray 12, the alignment boards 23*a* and 23*b* are situated at the position moved in the direction of arrow B (fourth position) and are away from the sheet S. In order to correct the misalignment in the direction of width of the sheet S falling on the processing tray 12, the alignment boards 23*a* and 23*b* move in the direction of arrow A (third position) and hold the sheet S between them to align the sheet in the direction of width.

Figure 12A:
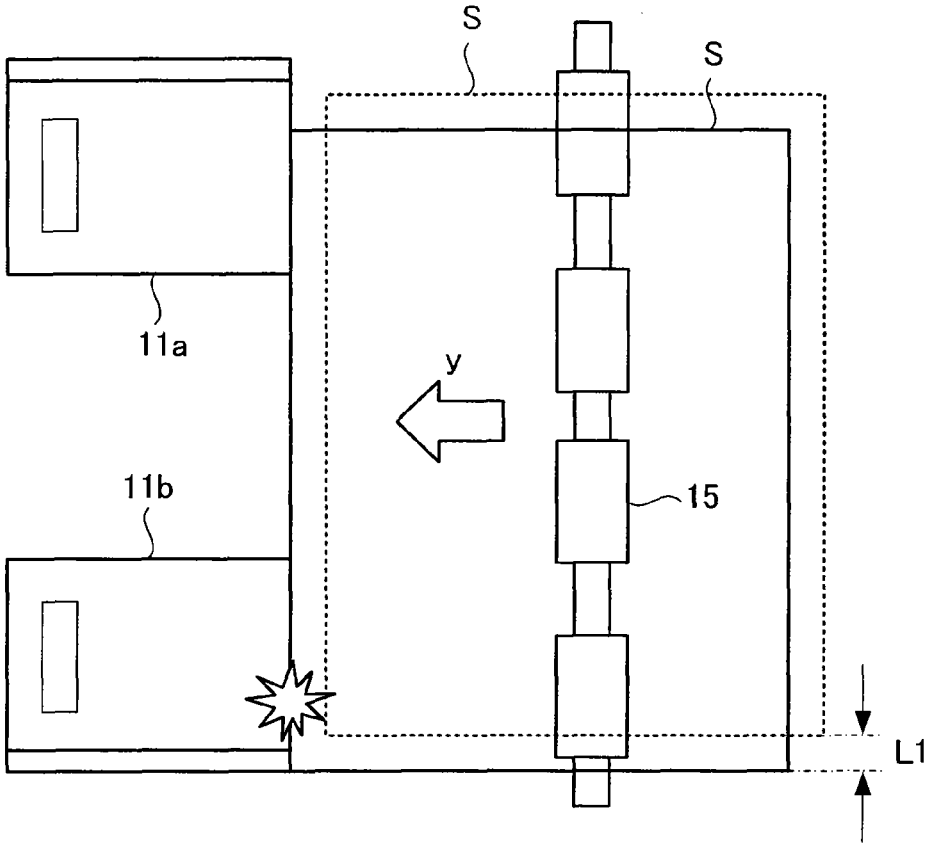
FIG. 12A and FIG. 12B are plan view and front view showing the operation of the standby tray and the lateral alignment unit where a sheet is misaligned.

There is no problem if the sheet S passes the center of the carrying path. However, when carried, the sheet S may be misaligned orthogonally from the center of the carrying path. FIG. 12A shows the state where the sheet S is misaligned by a distance L1 from the center (the position indicated by the dotted lines).

In a normal state, the tray members 11*a* and 11*b* stand by at the position shown in FIG. 12A. However, if the sheet S is carried with misalignment equal to or greater than a predetermined distance, for example, the distance L1 or greater, the sheet S collides with one of the tray members 11*a* and 11*b* and causes a jam. FIG. 12A shows an example where a forward end corner of the sheet S collides with the side wall of the tray member 11*b*.

When sorting the sheet, in the lateral alignment unit 23, for example, one alignment board 23*a* is used as a reference and the other alignment board 23*b* is moved to press the sheet S to the reference alignment board 23*a*. Alternatively, the other alignment board 23*b* is used as a reference and the one alignment board 23*a* is moved to press the sheet S to the reference alignment board 23*b*.

Figure 12B:
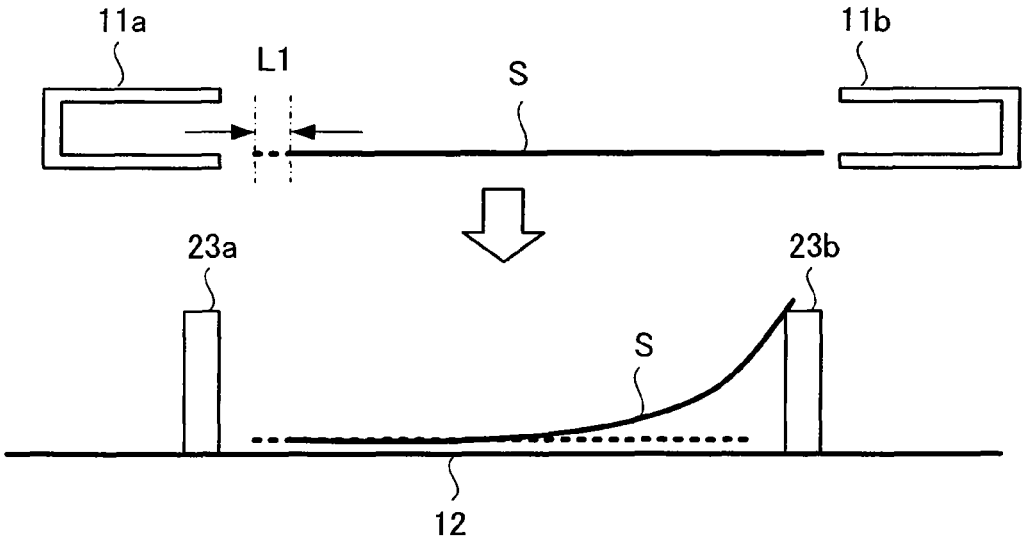

In the sort mode, the alignment boards 23*a* and 23*b* stand by at the position moved in the direction of arrow B. However, if the sheet S is misaligned by the distance L1 or more, the sheet S falls on one of the alignment boards 23*a* and 23*b* when falling onto the processing tray 12, as shown in FIG. 12B. Therefore, even if the sheet S falls onto the processing tray 12 without colliding with the tray members 11*a* and 11*b*, the sheet S falls on the alignment board 23*a* or 23*b* and cannot be aligned. FIG. 12B shows the state where an edge of the sheet S is on the alignment board 23*b*.

In the embodiment, when the sheet S misaligned in the direction orthogonal to the carrying direction is carried, the sensor group 56 of the punch unit 30 detects the lateral edge of the sheet S and measures the quantity of misalignment of the sheet S. In accordance with the result of the measurement, the movement of the tray members 11*a* and 11*b* or the alignment boards 23*a* and 23*b* is controlled and the quantity of misalignment is stored in the memory 69 (FIG. 10).

That is, when the puncher 35 moves in the direction of arrow A1 from the standby position as shown in FIG. 7B, the sensor group 56 detects the lateral edge of the sheet S and the amount of movement of the puncher 35 is decided in accordance with the misalignment of the sheet S. The quantity of misalignment of the sheet S can be found from the difference between the amount of movement of the puncher 35 when the sheet S passes the center of the carrying path and the amount of movement of the puncher 35 when the sheet S passes with misalignment. The amount of movement of the puncher 35 in direction A1 can be calculated from the number of driving pulses of the lateral registration motor 44.

If the quantity of misalignment of the sheet S is equal to or greater than a preset distance, the control unit 201 controls the motor 28 and the motors 291 and 292 and controls the position of the tray member 11*a* and 11*b* of the standby tray 11 and the position of the alignment boards 23*a* and 23*b* of the lateral alignment unit 23.

Figure 13:
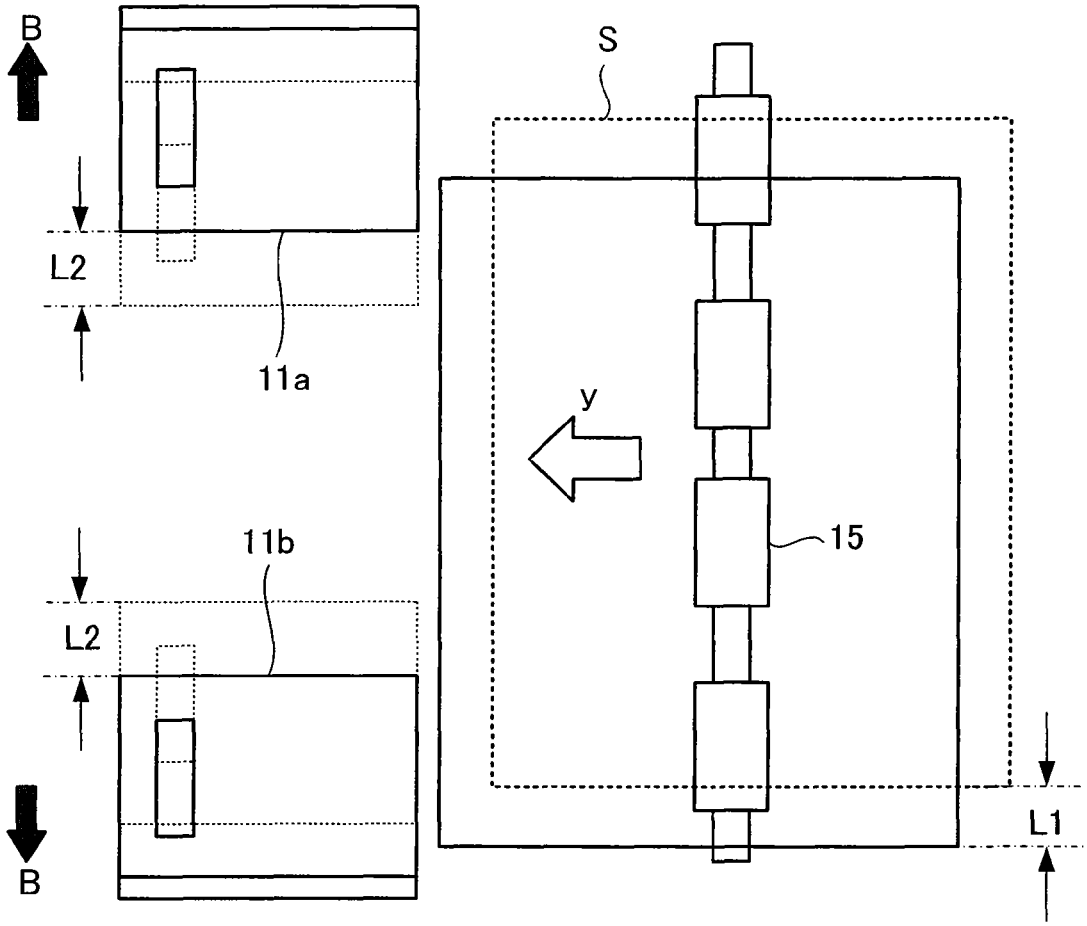
FIG. 13 is a plan view for explaining the operation of the standby tray.

FIG. 13 shows an example of controlling the position of the tray members 11*a* and 11*b* in accordance with the quantity of misalignment of the sheet S.

In FIG. 13, the position of the tray members 11*a* and 11*b* when the sheet S passes the center of the carrying path is indicated by dotted lines. If the sheet S is misaligned laterally by the distance L1, the control unit 201 measures the quantity of misalignment L1 based on the result of detection of the lateral edge by the punch unit 30. The control unit 201 controls the motor 28 to move the tray members 11*a* and 11*b* in the direction of arrow B in FIG. 13.

The tray members 11*a* and 11*b* move mutually outward (in direction B) by a distance L2 corresponding to the quantity of misalignment L1. The sheet S is supported by the tray members 11*a* and 11*b* without colliding with the tray member 11*b*.

If the distance between the tray members 11*a* and 11*b* is greater than the length of the sheet S in the direction of width, the sheet S falls off the tray members 11*a* and 11*b*. Therefore, the moving distance L2 of the tray members 11*a* and 11*b* needs to be set in consideration of the distance L1 and the size of the sheet S.

Figure 14A:
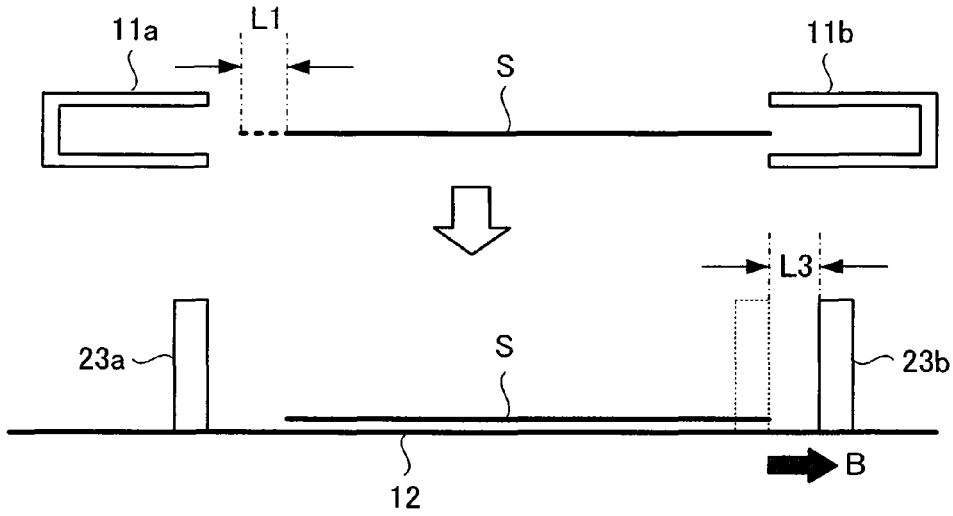
FIG. 14A and FIG. 14B are front views for explaining the operation of the lateral alignment unit.
Figure 14B:
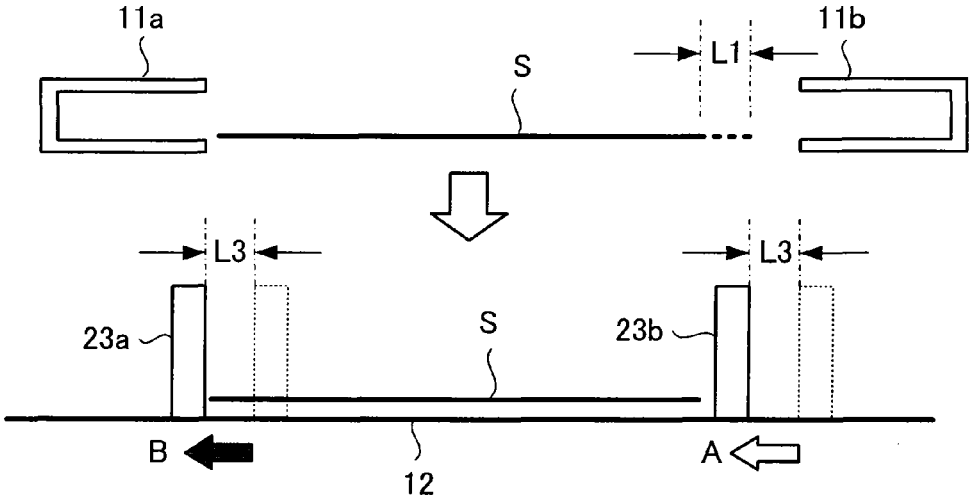

FIG. 14A and FIG. 14B shows an example of controlling the position of the alignment boards 23*a* and 23*b* in accordance with the quantity of misalignment of the sheet S. If the quantity of misalignment L1 measured on the basis of the result of detection of the lateral edge by the punch unit 30 is equal to or greater than a preset distance, the alignment boards 23*a* and 23*b* are moved by a distance L3 corresponding to the quantity of misalignment L1.

For example, assumed that in sorting, the alignment board 23*b* is moved with respect to the alignment board 23*a* as a reference surface and the sheet S is pressed toward the alignment board 23*a*, as shown in FIG. 14A. If the sheet S is misaligned toward the alignment board 23*b* as shown in FIG. 14A, only the alignment board 23*b* is moved outward (in direction B) by the distance L3. The sheet S falls onto the processing tray 12 without falling on the alignment board 23*b*. The distance L3 is set in accordance with the quantity of lateral misalignment L1.

If the sheet S is misaligned toward the alignment board 23*a* as the reference, as shown in FIG. 14B, simply moving the reference alignment board 23*a* outward (in direction B) eliminates inconvenience. However, since the alignment board 23*b* originally stands by at a position shifted outward in consideration of the quantity of misalignment, the alignment board 23*b* should be moved inward (in direction A) by the distance L3 in accordance with the measured quantity of misalignment L1. As the alignment board 23*b* is moved inward by the distance L3, the driving quantity in sorting can be reduced.

The lateral misalignment of the sheet S may occur unexpectedly. However, in most cases, the misalignment is caused when the user sets sheets in the cassette 8 or generated in the connecting part between the image forming apparatus 100 and the finisher 200. The misalignment often occurs to plural sheets S rather than a single sheet.

The measured quantity of misalignment of the sheet can be saved in the memory 69 and the movement of the standby tray 11 and the lateral alignment unit 23 can be controlled on the basis of the quantity of misalignment saved in the memory 69. If there are plural cassettes 8 in the image forming apparatus 100, the quantity of misalignment for each of the cassettes 8 may be saved in the memory 69.

If the sheet S is misaligned by a large quantity, the sheet S cannot be aligned simply by moving the alignment boards 23*a* and 23*b* once or twice. Therefore, if the quantity of lateral misalignment is equal to or greater than a predetermined quantity, the number of times the alignment by the alignment boards 23*a* and 23*b* is performed may be increased. Alternatively, the driving speed of the motors 291 and 292 driving the alignment boards 23*a* and 23*b* may be slowed down to decelerate the alignment and the alignment property may be improved.

If the number of times the alignment by the alignment boards 23*a* and 23*b* is performed is increased or the alignment speed is decelerated, the finishing time is increased. Therefore, the control unit 201 may request the image forming apparatus 100 to change the image forming cycle and create a delay time.

Increasing the number of times the alignment is performed or decelerating the alignment speed one by one for all sheets that are carried in, is disadvantageous in terms of efficiency. Therefore, the sheets may be collectively aligned plural times or the alignment speed may be decelerated collectively for the sheets when the last page of a sheet bundle to be aligned is carried or when the last page of sheets to be stapled by the stapler 13 is carried.

In the above embodiment, even if a carried sheet is misaligned, occurrence of a jam and misalignment can be avoided and normal alignment can be realized.

Next, a second embodiment will be described.

Figure 15A:
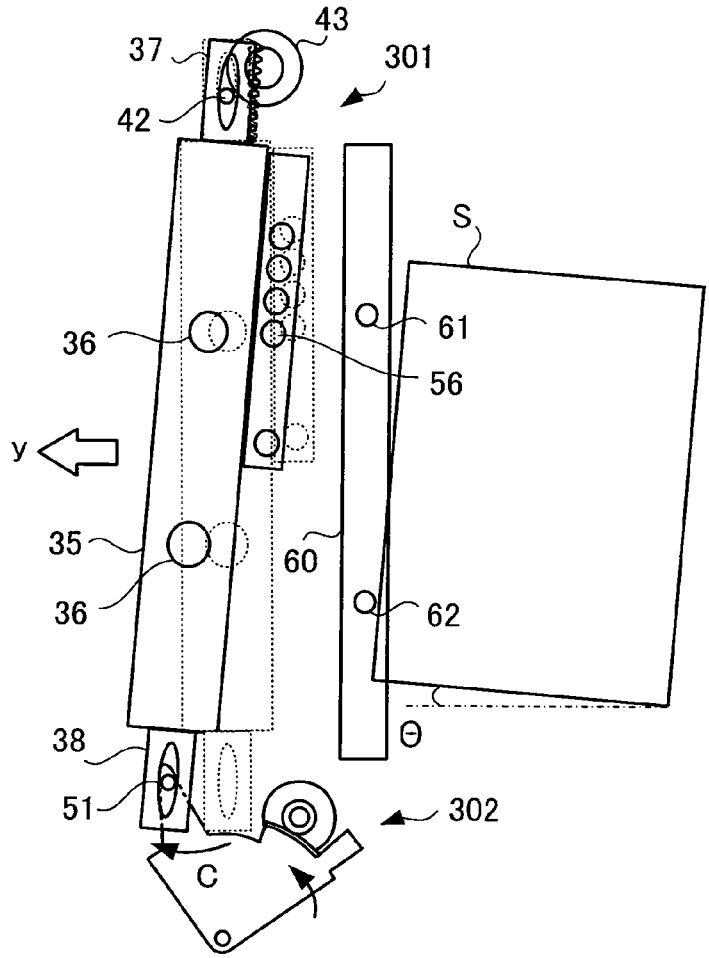
FIG. 15A and FIG. 15B are plan views for explaining skew correction and the quantity of misalignment of a skewed sheet in a second embodiment.

As shown in FIG. 15A, the punch unit 30 calculates the skew quantity (inclination angle θ) of the forward edge of the sheet S on the basis of the result of detection by the skew detection unit 60. In accordance with the inclination angle θ, the longitudinal registration motor 53 of the posture control mechanism 302 is driven to incline the puncher 35 and the skew of the sheet S is corrected.

A characteristic feature of the second embodiment is that the skew quantity of the sheet S is stored in the memory 69 when the skew occurs. The control unit 201 calculates the quantity of misalignment of the sheet S on the basis of the skew quantity stored in the memory 69 and controls the standby tray 11 and the lateral alignment unit 23.

Figure 15B:
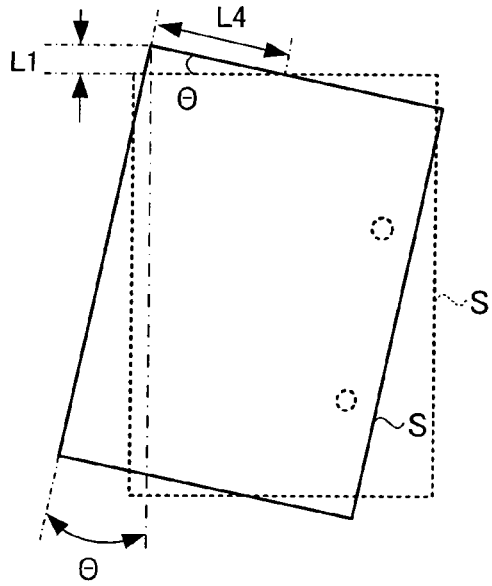

That is, if the skewed sheet S is carried, the sheet S is sent to the staple unit 10 with the forward edge of the sheet S misaligned by the distance L1, as shown in FIG. 15B. The corners of the sheet S collide with the tray member 11*a* and 11*b* of the standby tray 11, causing a jam, or the corners of the sheet S override the alignment boards 23*a* and 23*b*, hindering alignment.

If the sheet S is skewed, the length from the center position of the sheet S in the carrying direction to the forward edge is L4 and the inclination angle is θ, the quantity of misalignment L1 can be found by $L1=L4\times\cos\theta$. Since the length L4 is decided in accordance with the sheet size, the quantity of misalignment L1 can be easily calculated.

The control unit 201 calculates the quantity of misalignment L1 of the sheet S based on the skew quantity stored in the memory 69 and controls the motor 28 of the standby tray 11 and the motors 291 and 292 of the lateral alignment unit 23. The tray members 11*a* and 11*b* are moved as in FIG. 13 and the alignment boards 23*a* and 23*b* are moved as in FIG. 14A and FIG. 14B.

The skew of the sheet S may occur unexpectedly. However, in most cases, the skew is caused by misalignment when the user sets sheets in the cassette 8 or generated by misalignment in the connecting part between the image forming apparatus 100 and the finisher 200. Also, the skew often occurs to plural sheets S rather than a single sheet.

If there are plural cassettes 8 in the image forming apparatus 100, the generated skew quantity for each of the cassettes 8 may be saved in the memory 69.

If the skew quantity is large, the sheet S cannot be aligned simply by moving the alignment boards 23*a* and 23*b* once or twice. If the skew quantity (the calculated quantity of misalignment) is equal to or greater than a predetermined quantity, the number of times the alignment by the alignment boards 23*a* and 23*b* is performed may be increased. Or, the driving speed of the motors 291 and 292 driving the alignment boards 23*a* and 23*b* may be slowed down to decelerate the alignment speed.

In the second embodiment, even if a sheet is skewed, occurrence of a jam and misalignment can be prevented.

The invention is not limited to the above embodiments and various modifications can be made without departing from the attached claims.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. A sheet finishing apparatus comprising:

a carrying mechanism which carries a sheet in a carrying direction;

a puncher which moves to a penetrate position where the puncher punches a hole in the sheet that is carried and to a standby position where the puncher is retreating in a direction orthogonal to the carrying direction, and punches a hole in the sheet at the penetrate position;

a detection unit which detects a lateral edge of the sheet;

a standby tray which has a pair of tray members movable in a direction orthogonal to the carrying direction and supports the sheet passed through the puncher, with the pair of tray members;

a processing tray which receives the sheet falling from the standby tray;

a finishing unit including a lateral alignment unit which has a pair of alignment boards movable in a direction orthogonal to the carrying direction and aligns the sheet on the processing tray by holding the sheet between the pair of alignment boards;

a moving mechanism which moves the position of the tray members or the alignment boards in a direction orthogonal to the carrying direction; and a control unit which measures a quantity of misalignment from the center of a carrying path of the sheet by using a result of detection of the lateral edge from the detection unit, and controls the moving mechanism in accordance with the quantity of misalignment.

2. The apparatus of claim 1, wherein the finishing unit controls movement of the pair of alignment boards to sort and discharge the sheet.

3. The apparatus of claim 1, wherein the finishing unit includes a stapler which staples a bundle of the sheets aligned by the pair of alignment boards.

4. The apparatus of claim 1, wherein the detection unit detects the lateral edge of the sheet while the puncher moves from the standby position to the penetrate position, and the control unit controls the position of the puncher so as to set the penetrate position on the basis of the result of the detection of the lateral edge by the detection unit.

5. The apparatus of claim 1, wherein the control unit controls the moving mechanism to move the pair of tray members to a first position where the sheet is supported and a second position where the supported sheet is made to fall onto the lateral alignment unit, and if the quantity of misalignment of the sheet is equal to or greater than a preset quantity, the pair of tray members situated at the first position is moved toward the second position in accordance with the quantity of misalignment of the sheet.

6. The apparatus of claim 1, wherein the control unit controls the moving mechanism to move the pair of alignment boards to a third position where the sheet is aligned and to a fourth position which is away from the sheet, and if the sheet falling off the standby tray is misaligned to a position where the sheet falls on one of the alignment boards, at least the one alignment board of the pair of alignment boards situated at the fourth position is moved in a direction away from the sheet in accordance with the quantity of misalignment.

7. The apparatus of claim 1, wherein the control unit controls the moving mechanism to move, toward one alignment board to serve as a reference of the pair of alignment boards, the other alignment board, and sort the sheet, and if the sheet falling off the standby tray in the sort mode is misaligned to a position where the sheet falls on the one alignment board, the one alignment board is moved in a direction away from the sheet and the other alignment board is moved in a direction toward the sheet in accordance with the quantity of misalignment.

8. The apparatus of claim 1, wherein the control unit controls the moving mechanism to move, toward one alignment board to serve as a reference of the pair of alignment boards, the other alignment board, and sort the sheet, and if the sheet falling off the standby tray in the sort mode is misaligned to a position where the sheet falls on the other alignment board, the other alignment board is moved in a direction away from the sheet in accordance with the quantity of misalignment.

9. The apparatus of claim 1, wherein the control unit stores the measured quantity of misalignment of the sheet in a storage unit and controls the moving mechanism on the basis of the quantity of misalignment stored in the storage unit.

10. The apparatus of claim 1, wherein if the measured quantity of misalignment of the sheet is equal to or greater than a preset quantity, the control unit controls the moving mechanism to increase the number of times the alignment by the pair of alignment boards is performed or to decelerate alignment speed of the pair of alignment boards, and if the number of times the alignment is performed or the alignment speed is changed, an image forming cycle of an image forming apparatus connected to a preceding stage of the sheet finishing apparatus is changed.

11. A control method of a sheet finishing apparatus comprising:

having a puncher punches a hole in a sheet that is carried in a carrying direction;

situating the puncher at a penetrate position where the puncher punches a hole according to the carrying of the sheet and at a standby position where the puncher is retreating in a direction orthogonal to the carrying direction;

detecting a lateral edge of the sheet;

supporting the sheet passed through the puncher by a pair of tray members movable in a direction orthogonal to the carrying direction;

receiving the sheet falling off the standby tray, by a processing tray;

holding the sheet on the processing tray to align by a pair of alignment boards moving in a direction orthogonal to the carrying direction;

measuring a quantity of misalignment from the center of a carrying path of the sheet by using a result of detection of the lateral edge;

controlling the position of the pair of tray members or the pair of alignment boards in a direction orthogonal to the carrying direction in accordance with the quantity of misalignment; and finishing and discharging the aligned sheet.

12. The method of claim 11, wherein the finishing includes controlling movement of the pair of alignment boards to sort and discharge the sheet.

13. The method of claim 11, wherein the finishing includes stapling a bundle of the sheets aligned by the pair of alignment boards, by a stapler.

14. The method of claim 11, wherein the lateral edge of the sheet is detected while the puncher moves from the standby position to the penetrate position, and the penetrate position of the puncher is set on the basis of the result of the detection of the lateral edge.

15. The method of claim 11, wherein the pair of tray members is moved to a first position where the sheet is supported and a second position where the supported sheet is made to fall onto the processing tray, and if the quantity of misalignment of the sheet is equal to or greater than a preset quantity, the pair of tray members situated at the first position is moved toward the second position in accordance with the quantity of misalignment of the sheet.

16. The method of claim 11, wherein the pair of alignment boards is moved to a third position where the sheet is aligned and to a fourth position which is away from the sheet, and if the sheet falling off the standby tray is misaligned to a position where the sheet falls on one of the alignment boards, at least the one alignment board of the pair of alignment boards situated at the fourth position is moved in a direction away from the sheet in accordance with the quantity of misalignment.

17. The method of claim 11, wherein toward one alignment board to serve as a reference of the pair of alignment boards, the other alignment board is moved and the sheet is sorted, and if the sheet falling off the standby tray in the sort mode is misaligned to a position where the sheet falls on the one alignment board, the one alignment board is moved in a direction away from the sheet and the other alignment board is moved in a direction toward the sheet in accordance with the quantity of misalignment.

18. The method of claim 11, wherein toward one alignment board to serve as a reference of the pair of alignment boards, the other alignment board is moved and the sheet is sorted, and if the sheet falling off the standby tray in the sort mode is misaligned to a position where the sheet falls on the other alignment board, the other alignment board is moved in a direction away from the sheet in accordance with the quantity of misalignment.

19. The method of claim 11, wherein the measured quantity of misalignment of the sheet is stored in a storage unit and the position of the pair of tray members or the pair of alignment boards is controlled on the basis of the quantity of misalignment stored in the storage unit.

20. The method of claim 11, wherein if the measured quantity of misalignment of the sheet is equal to or greater than a preset quantity, control is performed to increase the number of times the alignment by the pair of alignment boards is performed or to decelerate alignment speed of the pair of alignment boards, and if the number of times the alignment is performed or the alignment speed is changed, an image forming cycle of an image forming apparatus connected to a preceding stage of the sheet finishing apparatus is changed.

* * * * *